US006220010B1

(12) United States Patent
Gomez

(10) Patent No.: US 6,220,010 B1
(45) Date of Patent: Apr. 24, 2001

(54) ORNAMENTAL CHAIN MADE UP OF SUCCESSIVE ELEMENTS EACH HAVING A GENERALLY SPHERICAL SHAPE

(75) Inventor: Luis Gomez, Soisy Sous Montmorency (FR)

(73) Assignee: Cartier International B.V., Amsterdam (NL)

( * ) Notice: Subject to any disclaimer, the term of this patent is extended or adjusted under 35 U.S.C. 154(b) by 0 days.

(21) Appl. No.: 09/485,234

(22) PCT Filed: Jun. 18, 1999

(86) PCT No.: PCT/FR99/01473

§ 371 Date: Mar. 29, 2000

§ 102(e) Date: Mar. 29, 2000

(87) PCT Pub. No.: WO99/65355

PCT Pub. Date: Dec. 23, 1999

(30) Foreign Application Priority Data

Jun. 19, 1998 (FR) ..... 98 07765

(51) Int. Cl.[7] ..... F16G 13/00
(52) U.S. Cl. ..... 59/80; 59/2
(58) Field of Search ..... 59/80, 2

(56) References Cited

U.S. PATENT DOCUMENTS

| | | | | |
|---|---|---|---|---|
| 3,066,501 | * | 12/1962 | Charles et al. | 59/2 |
| 3,323,325 | * | 6/1967 | Meyer | 59/2 |
| 3,385,050 | | 5/1968 | Hall . | |
| 4,237,702 | | 12/1980 | Caverly . | |
| 5,155,990 | * | 10/1992 | Poll | 59/80 |

FOREIGN PATENT DOCUMENTS

| | | |
|---|---|---|
| 297 15 033 U 1 | 6/1998 | (DE) . |
| 1237084 | 6/1960 | (FR) . |
| 257929 | 2/1927 | (GB) . |
| 750737 | 6/1956 | (GB) . |

* cited by examiner

*Primary Examiner*—David Jones
(74) *Attorney, Agent, or Firm*—Oliff & Berridge, PLC

(57) ABSTRACT

An ornamental chain made up of successive elements, in which at least one of said elements includes a hollow body inside which an insert is fixed that is designed to retain a link member that is linked to an adjacent element of the chain, said insert being constituted by at least one sleeve. The sleeve includes a slot that is wide enough to enable the shank of the link member to pass therethrough.

23 Claims, 6 Drawing Sheets

ORNAMENTAL CHAIN MADE UP OF SUCCESSIVE ELEMENTS EACH HAVING A GENERALLY SPHERICAL SHAPE

The present invention relates to an ornamental chain made up of successive elements each having a shape that is generally spherical, for example.

BACKGROUND OF THE INVENTION

It is known to make a chain of balls by means of a method consisting in chasing the material of a metal wire at regular intervals so as to form widened zones, each having a neck half-way along, in surrounding each zone in a sheet of metal formed into a ball, and then in breaking the wire at the neck of each widened zone inside the balls.

That method is not particularly well adapted to making an ornamental chain, particularly since the balls thus made do not lend themselves easily to setting precious stones.

A bead necklace is known from French patent FR-1 237 084, each bead including an elastically deformable add-on piece having an edge designed to retain the head of a link member linked to an adjacent bead. The add-on piece is presented in the form of a longitudinally slotted sleeve. When the head of the link member is put into place, the sleeve can deform elastically. Such a bead necklace is not entirely satisfactory. In particular, the add-on piece can turn out to be difficult to make in certain cases since the rim tends to prevent it from deforming elastically. In addition, there is the risk of the beads becoming detached in the event of strong traction being accidentally exerted on the necklace.

SUMMARY OF THE INVENTION

An object of the present invention is to provide an ornamental chain in which at least one of the successive elements which make up said chain includes a hollow body inside which an insert is fixed that is designed to retain a link member that is linked to an adjacent element of the chain, said insert being constituted by at least one sleeve.

In characteristic manner, the sleeve includes a slot that is wide enough to enable the shank of the link member to pass therethrough.

As a result of the invention, each element of the chain, as defined above, is not directly engaged with the link member.

It is the insert fixed inside the hollow body which serves to retain the link member.

This enlarges the choice of materials that can be used to make the hollow body.

The invention also enables a wide range of embodiments of said hollow body.

Setting a precious stone on the element is also facilitated since the hollow body can be designed to receive a specific support piece.

In a particular embodiment, the hollow body is spherical and it is advantageously made by turning, thereby enabling a particularly pleasing surface appearance to be obtained.

Still in a particular embodiment, the insert is fixed in a bore passing through the hollow body.

The insert can be retained as a force fit inside the hollow body.

The insert can have substantially no elasticity towards the outside.

When it is desired to mount a precious stone on the element, the hollow body preferably includes a blind bore of axis perpendicular to the axis of the insert in order to receive a support piece for said stone.

Another object of the invention is to use the above-mentioned support piece to improve the hold of an insert serving to retain a link member in the hollow body of an element of the chain.

In a particular embodiment, the support piece has a fork designed to be engaged astride the insert which advantageously presents a narrowing of its outside section. The support piece can thus assist in holding the insert in the hollow body of the element.

In a particular embodiment, the insert and the link member are designed so that said link member is retained in the insert with the possibility of rotating about the axis of the insert. The insert and the link member are preferably designed so that said link member is retained in the insert with the possibility of being displaced along the axis of the insert. The link member advantageously includes an enlarged head at its end retained in the insert and said insert has a narrowing of its inside section. The insert is preferably constituted by two longitudinally-slotted sleeves, each having a narrowing of its inside section. The sleeves are advantageously designed to interfit one inside the other. The link member can be constituted by a two-headed pin having a length lying in the range 2 mm to 20 mm, for example.

In another particular embodiment, the link member is mounted in the insert with the possibility of pivoting about a pivot axis perpendicular to the axis of the insert. The link member advantageously has a shank of rectangular cross-section whose long sides are perpendicular to the above-mentioned pivot axis, said shank being provided with a hole at each of its ends through which a respective peg passes. Each peg is preferably engaged, via its ends, in holes made in the insert, said insert possibly being a single block.

At each of its axial ends, the insert advantageously has a surface, e.g. a spherical surface, that is situated in continuation with the outside surface of the hollow body, this being advantageous from the point of view of appearance.

BRIEF DESCRIPTION OF THE DRAWINGS

Other characteristics and advantages of the present invention will appear on reading the following detailed description of non-limiting embodiments of the invention, and on examining the accompanying drawings, in which.

MORE DETAILED DESCRIPTION

Figure 1:
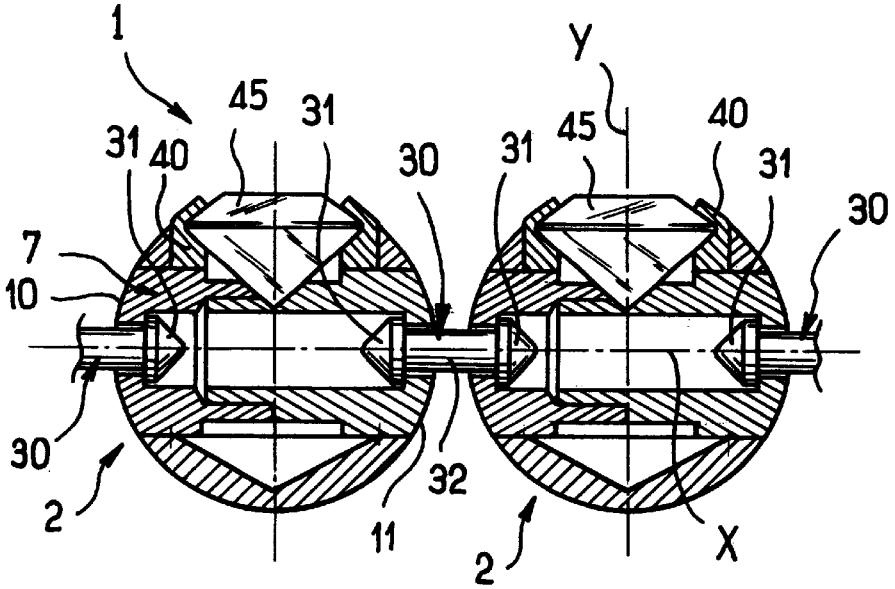
FIG. 1 is a section of an ornamental chain of the invention, showing two consecutive elements.

The ornamental chain 1, of which only two identical successive elements 2 are shown in FIG. 1, can be used in the manufacture of a bracelet or of a necklace, for example.

Each element 2 includes a hollow metal body 3 with a spherical outside surface 4 that is made by turning on an automatic lathe.

The hollow body 3 has a bore 5 passing therethrough on an axis X coinciding with a diameter of the body and it also includes a blind bore 6 of diameter greater than the diameter of the bore 5 on an axis Y perpendicular to the axis X and opening out into the bore 5.

Figure 3:
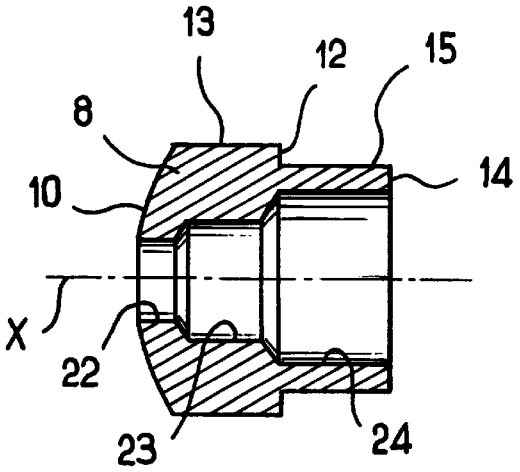
FIGS. 3 and 4 are sections showing, in isolation, the two sleeves constituting the insert fixed in the hollow body of an element of FIG. 1.
Figure 4:
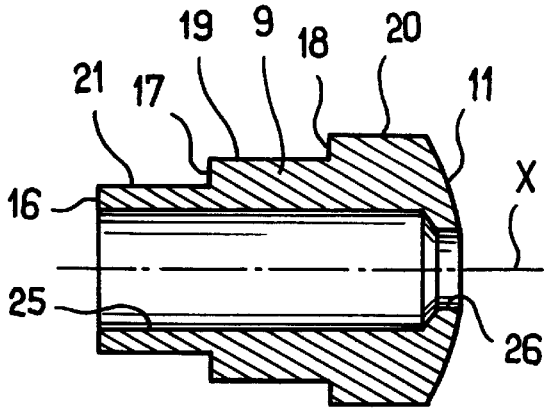

Each element 2 houses an insert 7 constituted by an assembly of a female sleeve 8 and of a male sleeve 9, shown in isolation in FIGS. 3 and 4.

At one axial end, each sleeve 8, 9 has a spherical surface respectively referenced 10, 11, said surfaces being situated, once the insert 7 is in place in the hollow body 3, in continuation with the spherical surface 4 of said hollow body, as can be seen in FIG. 1.

The female sleeve 8 has an outside surface that is circularly symmetrical about the axis X, and that is provided with a shoulder 12 which defines, adjacent to the end 10, a circularly cylindrical surface 13 having a diameter that corresponds substantially to the diameter of the bore 5 of the hollow body 3, and adjacent to the opposite end 14, a surface 15 that is also circularly cylindrical, having a diameter that is less than the diameter of the surface 13.

The male sleeve 9 has a circularly cylindrical outside surface provided with shoulders 17 and 18 which define between them a circularly cylindrical surface 19 having a diameter that is the same as the diameter of the surface 15 of the female sleeve 8.

The shoulder 18 defines, adjacent to the end 11, a circularly cylindrical surface 20 having a diameter that is the same as the diameter of the surface 13 of the female sleeve 8.

The shoulder 17 defines, adjacent to the opposite end 16, a circularly cylindrical surface 21 having a diameter that is less than the diameter of the surface 19.

The inside section of the male sleeve 9 has a constant diameter in a region 25 that extends over a major portion of its length and that narrows at 26 in the vicinity of the end 11.

The inside section of the female sleeve 8 is stepped and narrows at 22 in the vicinity of the end 10.

The inside section of the opening of the female sleeve 8 at the end 14 corresponds to the section of the surface 21 of the male sleeve so that the sleeves 8 and 9 can interfit to constitute the insert 7, the shoulders 14 and 17 coming into abutment against each another.

The diameter of the inside section of the female sleeve 8 in the intermediate region 23 between the narrowing 22 and the opening 24 is equal to the diameter of the inside section of the male sleeve 9 at the end 16.

The diameters of the narrowings 22 and 26 are equal.

Two successive elements 2 are linked together by a link element which is presented, in the embodiment described, in the form of a pin 30 including a circularly cylindrical shank 32 and, at each of its ends, a head 31 of greater diameter.

The pin 30 can be made of metal wire, for example, by chasing the material of said wire locally and at regular intervals so as to form widened zones, each having a neck half-way along, and then by sectioning the wire at said necks.

The diameter of the shank 32 is slightly less than the diameter of the narrowings 22 and 26, while the diameter of the regions 23 and 25 is slighter greater than the diameter of the heads 31.

Figure 5:
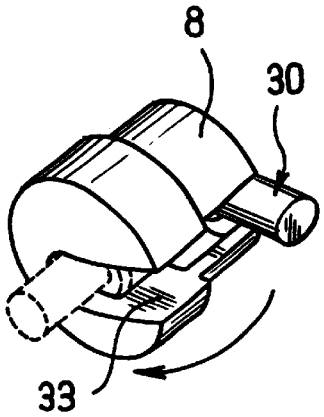
FIGS. 5 and 6 show a first link member being put into place in one of the sleeves.
Figure 7:
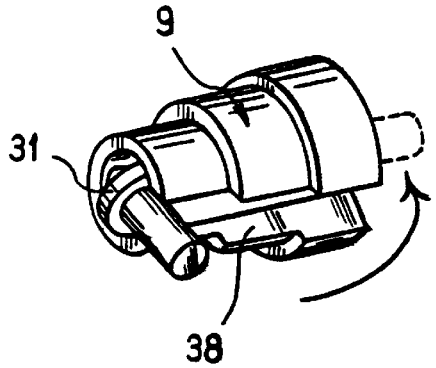
FIGS. 7 and 8 show a second link member being put into place in the other sleeve.
Figure 8:
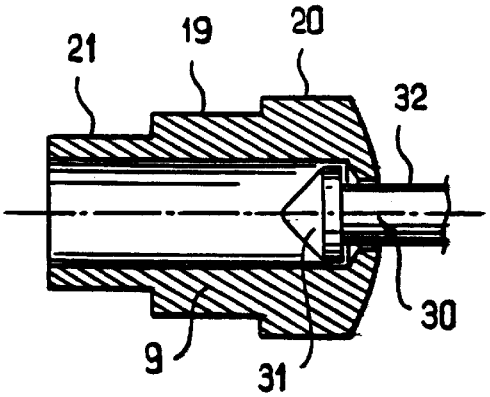
Figure 9:
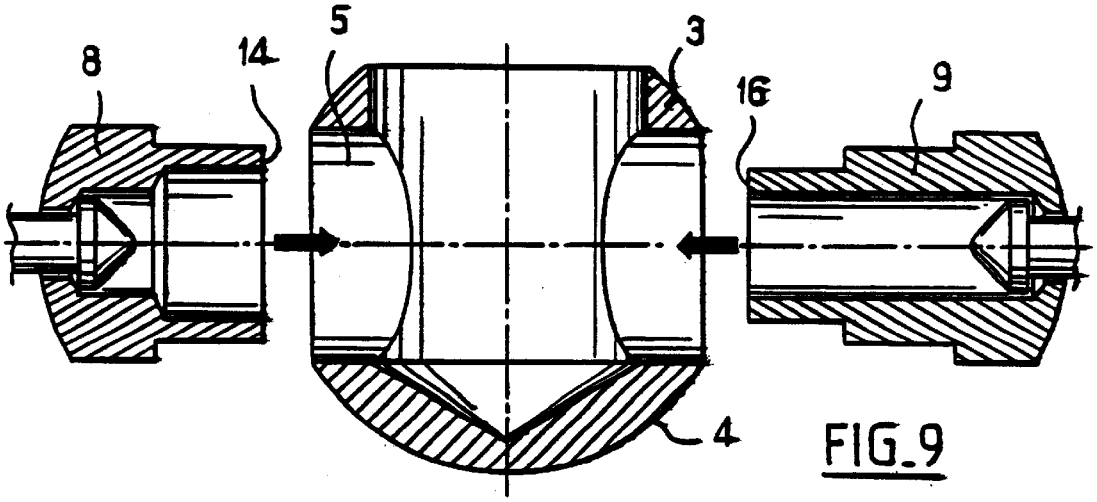
FIGS. 9 and 10 show the two sleeves being assembled inside the hollow body of the element.

In the example described, the sleeves 8 and 9 are axially slotted along their entire length so as to enable the head 31 of a pin 30 to be inserted therein, as shown in FIGS. 5 and 7.

In the case of the female sleeve 8, the head 31 is inserted via the end 14, the axis of the shank 32 thus being substantially perpendicular to the axis X, the pin 30 is then displaced parallel to said axis until the head 31 comes into abutment against the narrowing 22.

The pin 30 is then pivoted through one-fourth of a turn to take the position shown by dashed lines in FIG. 5, the shank 32 thus being substantially on the axis X.

The width of the opening of the slot 33 made in the female sleeve 8 is slightly greater than the diameter of the shank 32 of the pin 30.

In addition, the pin 30 is put in place in the male sleeve 9 by inserting the head 31 via the end 16, the axis of the shank 32 thus being substantially perpendicular to the axis X, and then by sliding the pin 30 parallel to said axis until the head 31 comes into abutment against the narrowing 26.

The pin 30 is then pivoted through one-fourth of a turn so as to bring the shank 32 onto the axis X of the sleeve 2, as shown by dashed lines in FIG. 7.

Figure 6:
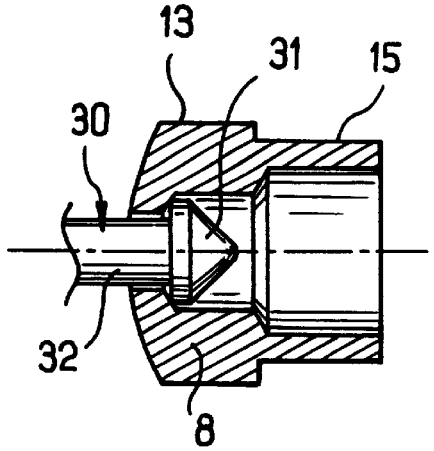
Figure 10:
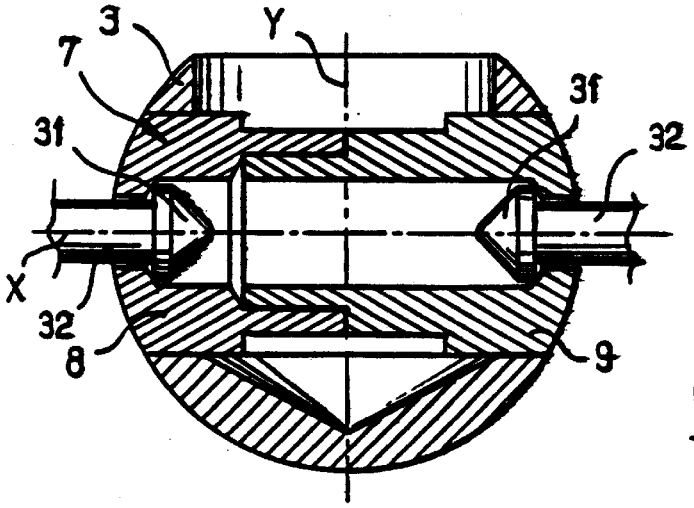
Figure 12:
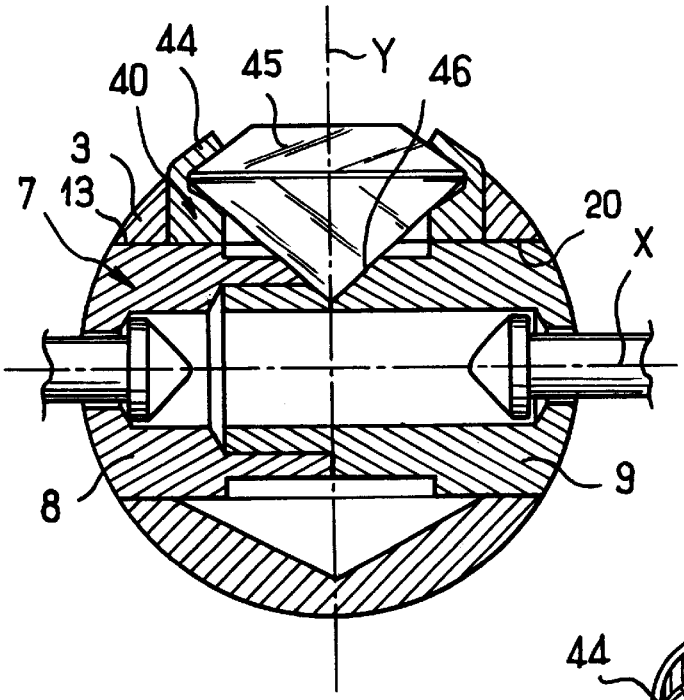
FIG. 12 shows the support piece in place inside the hollow body.

Once the heads 31 of the pins 30 are in place in the sleeves 8 and 9, the sleeves are inserted via their respective ends 14 and 16 into the bore 5, as shown in FIG. 6, and interfit one inside the other to constitute the insert 7, as can be seen in FIG. 10.

The sleeves 8 and 9 preferably interfit as a force fit so that they remain assembled by friction. The sleeves 8 and 9 can have no significant elasticity.

The sleeves 8 and 9 are retained inside the bore 5 by the force fit between the surface 13 of the female sleeve 8 and the surface 20 of the male sleeve 9.

Naturally, it is not beyond the ambit of the present invention for the sleeves 8 and 9 to be assembled and then fixed in the hollow body 3 by soldering or by any other conventional means.

Figure 11:
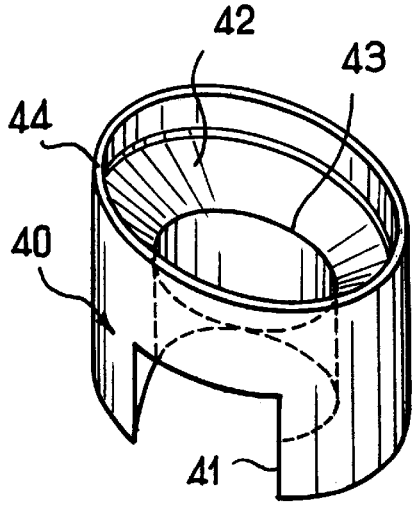
FIG. 11 shows, in isolation, a support piece for a precious stone.

In the embodiment described, a precious stone 45 is set on each element 2 by means of a support piece 40, shown in isolation in FIG. 11.

The support piece 40 is presented in the form of a circularly cylindrical body that is cut out at its bottom portion to form a fork 41 designed to be engaged astride the insert 7, and hollowed out at its top portion to form a conical housing 42.

The width of the opening of the fork 41 corresponds to the diameter of the surfaces 13 and 20.

The diameter of the support piece 40 corresponds to the diameter of the blind bore 6 so that it is held therein as a force fit.

The housing 42 is surmounted by a thin wall 44 designed to be pressed down onto the stone 45 during the setting operation.

The bottom 43 of the housing 42 is pierced to enable a countersink 46 to be made in the insert 7 once the support piece 40 has been inserted without the stone 45 in the hollow body 3, said countersink being designed to receive the bottom end of the stone 45.

The fork 41 is engaged on the insert 7 by friction, thereby providing both additional strength for retaining the support piece 40 and the insert 7 inside the hollow body 3, and reinforcement for the assembled sleeves 8 and 9.

Figure 13:
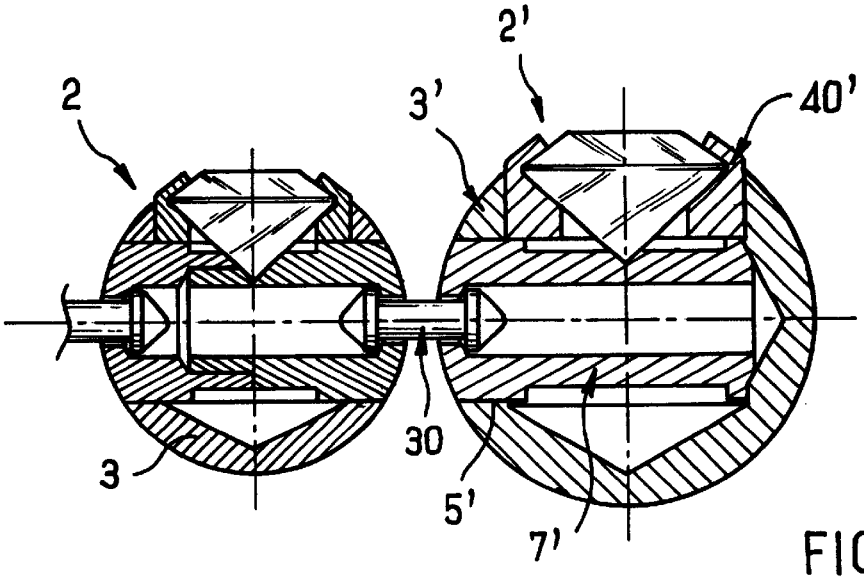
FIG. 13 shows an end element assembled to the rest of the chain.
Figure 14:
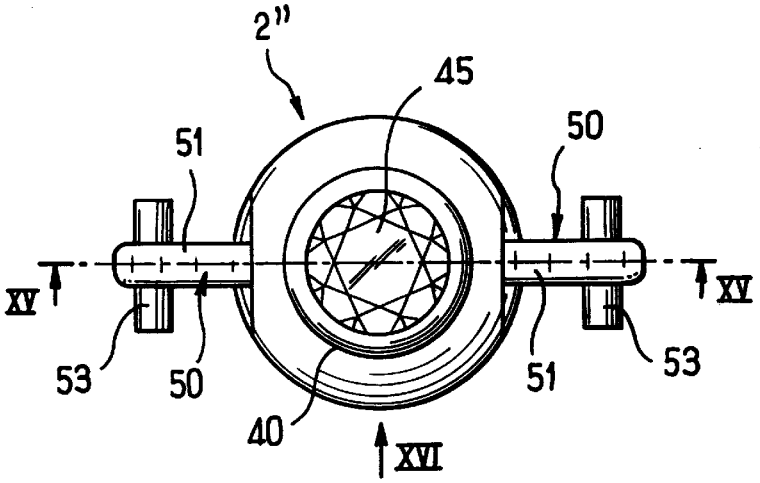
FIG. 14 is a diagrammatic plan view of an element in accordance with a third embodiment of the invention.
Figure 15:
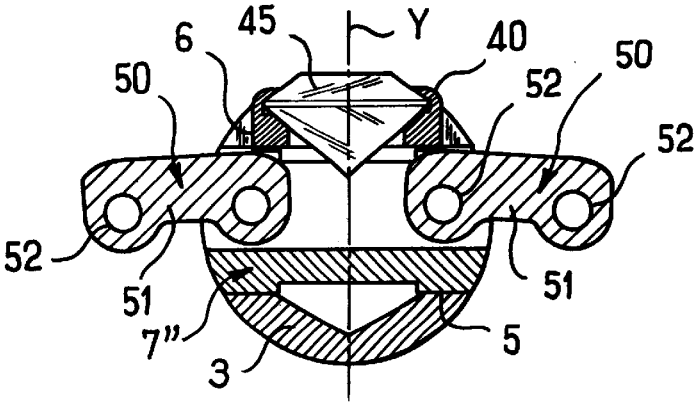
FIG. 15 is a diagrammatic section view on dashed line XV—XV of FIG. 14.
Figure 16:
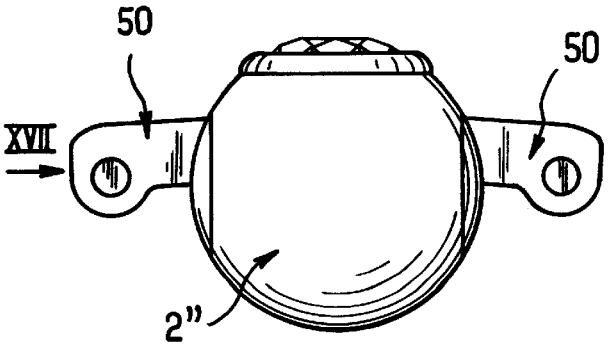
FIG. 16 is a front view on arrow XVI of FIG. 14.
Figure 17:
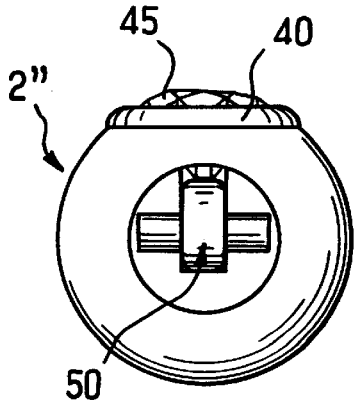
FIG. 17 is a side view on arrow XVII of FIG. 16.

FIG. 13 shows an element 2 such as described above, assembled via a pin 30 to an end element 2' which differs from the element 2 by the fact that the hollow body 3' and the support piece 40' are slightly fatter, and by the fact that the bore 5 does not pass right through, but is blind and receives a single-block insert 7'.

More particularly, the insert 7' is constituted here by a sleeve whose inside section has a narrowing, said insert being force fitted in the bore 5 and being longitudinally slotted for mounting the head 31 of the pin 30 like the above-described sleeves 8 and 9.

As shown, the pins 30 are preferably retained with a certain amount of clearance inside the inserts 7 and 7', and the successive elements of the chain can thus rotate relative to one another about the axis X and can be displaced in translation along said axis X.

Advantageous esthetic effects can be obtained as a result of this mobility, since the relative orientations of the stones are thus never fixed.

Without going beyond the ambit of the present invention, the insert fixed in the hollow body of an element 2 or 2' can serve to retain one end of a link member that is linked at the other end to a chain of balls obtained by the conventional method recalled at the beginning.

Figure 2:
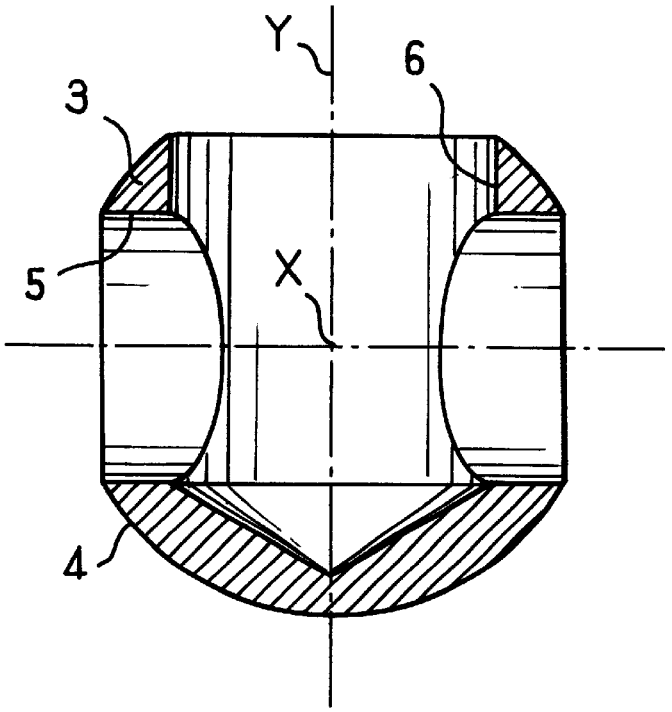
FIG. 2 shows, in isolation, the hollow body of one of the elements of FIG. 1.

In the embodiment in FIGS. 14 to 20, each element 2" of the chain includes a hollow body 3 that is identical to the hollow body shown in FIG. 2.

Figure 18:
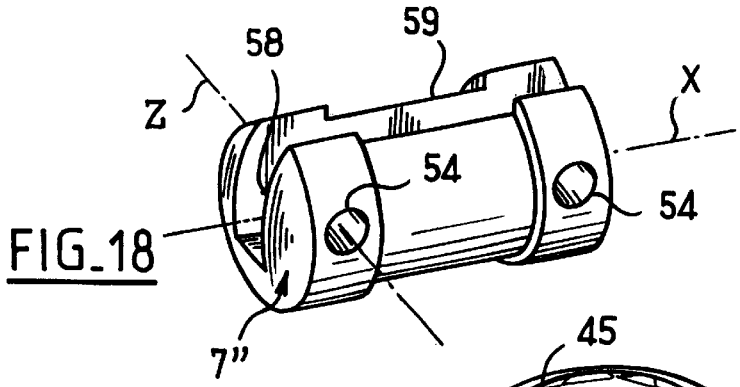
FIG. 18 shows, in isolation and in perspective, the insert of the element shown in FIGS. 14 to 17.
Figure 19:
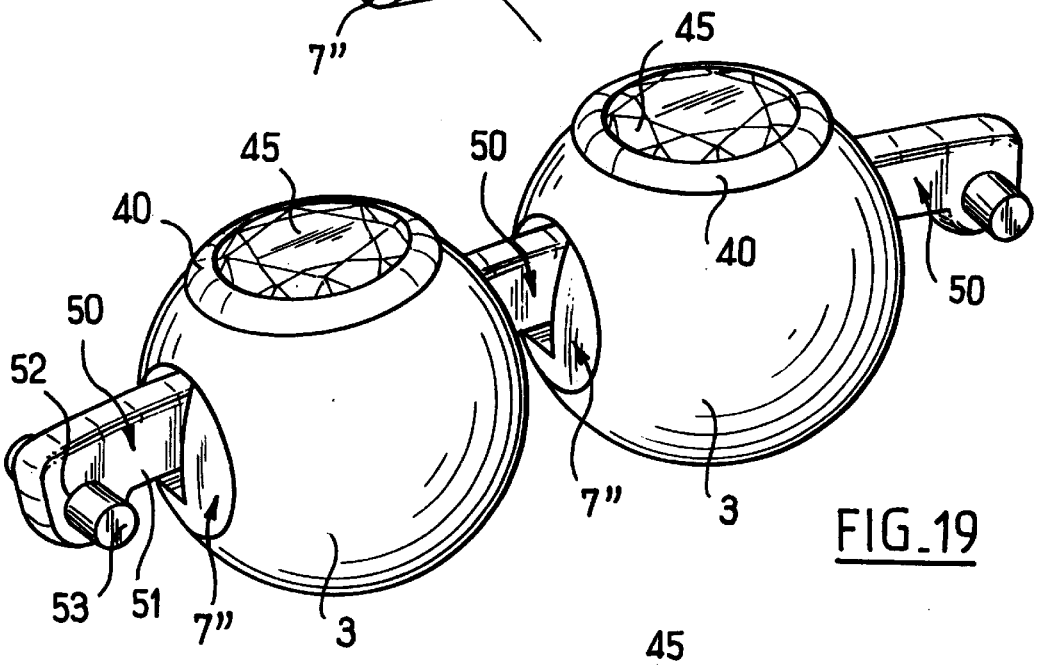
FIG. 19 is a diagrammatic view, in perspective, showing two assembled-together elements.
Figure 20:
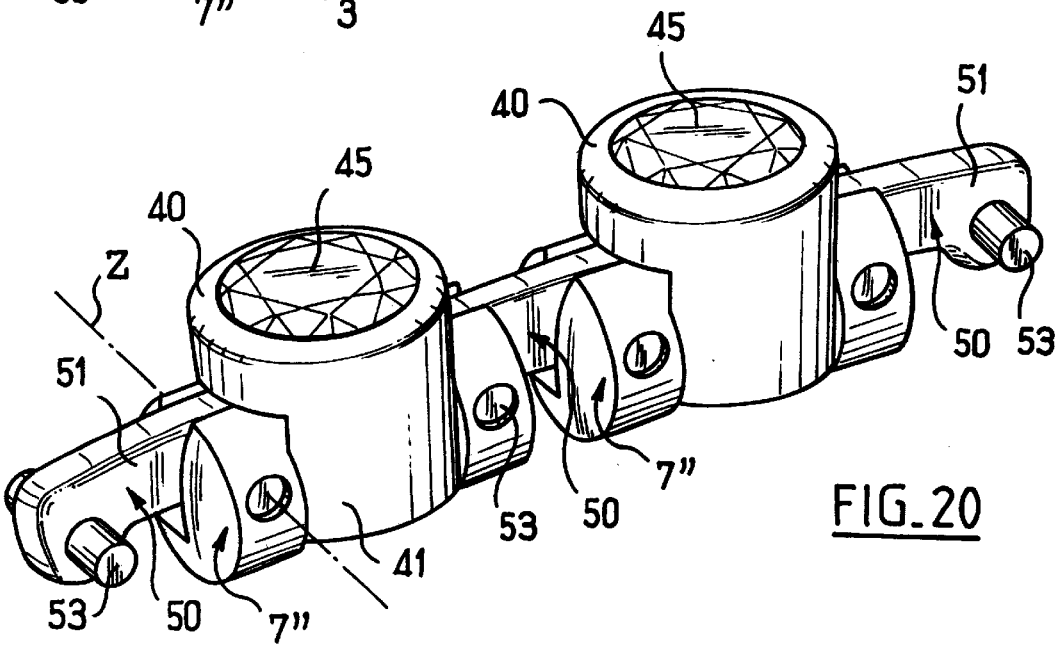
FIG. 20 is a view similar to FIG. 19, the hollow body of the elements being removed to show the inserts and the link members.

The hollow body receives an insert 7", shown in isolation in FIG. 18, and a support piece 40 that is identical to the support piece described above with reference to FIG. 11.

The elements 2" are linked together by link members 50 with the possibility of pivoting about pivot axes Z perpendicular to the axis X of the inserts 7".

More particularly, each link member 50 includes a shank 51 of rectangular cross-section whose long sides are perpendicular to the pivot axes Z, said shank being provided with a hole 52 at each of its two ends in which a respective peg 53 is engaged, the ends of said pegs being engaged in holes 54 in the insert 7". The axes of the holes 54 intersecting the axis X perpendicularly.

The insert 7" outwardly presents the same shape as the insert 7 shown in FIG. 10, with the exception of the holes 54. It has a slot 58 passing axially therealong which, in the example described, extends along its entire length, and has a narrowing 59 of its outside section. In the example described, the slot 58 has a rectangular cross-section whose long sides are perpendicular to the axes of the holes 54. The depth of the slot 58 corresponds substantially to three-fourths of the greatest outside diameter of the insert 7".

It is not beyond the ambit of the present invention for the insert 7" to be longitudinally slotted at its axial ends only over a distance that is just long enough to enable the link members 50 to be engaged.

In a variant embodiment (not shown), the insert is not longitudinally slotted along its entire length but only at its axial ends.

In this case, the insert can have a slot at each of its axial ends, which slot extends over the entire height of the insert, passing vertically therethrough.

The shape of the stone that may be fixed on the ball in which the insert is engaged, thus takes account of the fact that the insert is not longitudinally slotted along its entire length.

It is necessary to give the term "slot" used in the present description a broad sense, the slot possibly having a cross-section that does not necessarily include two parallel sides.

In a variant embodiment (not shown), the slot enabling the end of the link member to be mounted does not open out to the side surface of the insert but only to the end surface of the insert, said surface being designed to continue the outside surface of the hollow body.

To assemble the elements 2", the ends of two link members 50 are firstly inserted in the slot 58 of the insert 7", e.g. by inserting them along the axis X of the insert 7", so as to make the holes 52 and 54 coincide, the pegs 53 are then inserted in said holes. It is assumed that one of the link members 50 is already assembled to an element 2" and that the other is free.

The insert 7" is then inserted in the bore 5 of the body 3 and the support piece 40 is then put into place, the fork 41 becoming engaged on the above-mentioned section narrowing 59.

The embodiment in FIGS. 14 to 20 enables the stones to be held in a given orientation about the axis X of the inserts.

Naturally, it is not beyond the ambit of the present invention for the nature and the shape of the successive elements making up the chain to be modified, said elements possibly not receiving precious stones, the hollow bodies of the elements possibly being made with beads, for example.

What is claimed is:

1. An ornamental chain, comprising:

a plurality of successive elements, at least one of said elements comprising a hollow body; and at least one link member, each link member linking adjacent ones of said elements, an insert being fixed inside the hollow body, the insert retaining one of the at least one link members, said insert comprising at least one sleeve that includes a slot wide enough to enable a shank of the link member to pass through the slot, the slot opening to an end of the sleeve and forming a non-circular opening in the end of the sleeve.

2. A chain according to claim 1, wherein said hollow body is spherical.

3. A chain according to claim 1, wherein said hollow body is made by turning.

4. A chain according to claim 1, wherein said insert is fixed in a bore passing through the hollow body.

5. A chain according to claim 1, wherein that the hollow body includes a blind bore perpendicular to an axis of the insert in order to receive a support piece that supports a gem.

6. A chain according to claim 5, wherein said support piece has a fork that engages astride outside of the insert.

7. A chain according to claim 1, wherein the insert is retained as a force fit inside said hollow body.

8. A chain according to claim 1, wherein the link member includes a head at least one end to be retained in the insert.

9. A chain according to claim 1, wherein the insert is constituted by two longitudinally-slotted sleeves, each sleeve having a narrowing therein.

10. A chain according to claim 9, wherein said two sleeves interfit one inside the other.

11. A chain according to claim 1, wherein said link member is retained in the insert and is rotatable about an axis of the insert.

12. A chain according to claim 1, wherein said link member is retained in the insert and displaceable along an axis of the insert.

13. A chain according to claim 1, wherein the link member is constituted by a pin having two heads.

14. A chain according to claim 13, wherein the length of the pin lies in the range about 2 mm to about 20 mm.

15. A chain according to claim 1, wherein the link member is mounted in the insert and pivots about a pivot axis perpendicular to an axis of the insert.

16. A chain according to claim 15, wherein the shank of the link member has a rectangular cross-section, long sides of the rectangular cross-section being perpendicular to the pivot axis, said shank being provided with two holes that each receive a peg.

17. A chain according to claim 16, wherein at least one hole is provided in the insert, and each peg engages one of the holes provided in the insert.

18. A chain according to claim 15, wherein the insert is a single block.

19. A chain according to claim 1, wherein the insert has a surface that is continuous with an outside surface of the hollow body.

20. A chain according to claim 1, wherein the insert is substantially without elasticity towards an outside.

21. A chain according to claim 6, wherein an outside section of the insert is narrowed with respect to an interior portion of the insert.

22. A chain according to claim 19, wherein the surface that is designed to be situated in continuation with the outside surface is a spherical surface.

23. A chain according to claim 1, wherein the slot extends to an outer periphery of the sleeve.

* * * * *